United States Patent [19]

Colvin

[11] Patent Number: 4,646,847

[45] Date of Patent: Mar. 3, 1987

[54] CHIMNEY FIRE EXTINGUISHING APPARATUS

[76] Inventor: George Colvin, Box 2638-A, Viewtown, Va. 22746

[21] Appl. No.: 667,336

[22] Filed: Nov. 1, 1984

[51] Int. Cl.[4] ..... A62C 3/04

[52] U.S. Cl. ..... 169/49; 98/86; 126/287.5; 169/59; 169/23

[58] Field of Search ..... 169/23, 42, 46, 48, 169/49, 57, 59; 98/59, 67, 86; 126/287.5; 137/72, 74, 75, 77; 110/184

[56] References Cited

U.S. PATENT DOCUMENTS

| | | | |
|---|---|---|---|
| 302,980 | 8/1884 | Buell | 137/72 |
| 314,121 | 3/1885 | Gilman | 126/287.5 |
| 1,352,255 | 9/1920 | Emerson | 126/287.5 |
| 2,270,073 | 1/1942 | Merry | 126/287.5 |
| 2,334,121 | 11/1943 | Olshin | 98/86 |
| 4,334,460 | 6/1982 | Simmons et al. | 98/67 X |
| 4,384,617 | 5/1983 | Mueller | 169/57 |

FOREIGN PATENT DOCUMENTS

| | | | |
|---|---|---|---|
| 1116921 | 1/1978 | Canada | 169/48 |
| 544465 | 9/1922 | France | 126/287.5 |
| 1246513 | 9/1971 | United Kingdom | 126/287.5 |

*Primary Examiner*—Andres Kashnikow
*Attorney, Agent, or Firm*—Kenneth E. Darnell

[57] ABSTRACT

Apparatus capable of fitting over the upper exposed end of a chimney liner and operable in the event of a chimney fire to extinguish the fire, the invention can be fitted to existing chimney structures without alteration of the chimney or liner structure. The present apparatus includes an air flow restriction plate which is held in a position allowing free flow through the chimney in normal use situations, the plate being held in place by a heat fusible element. The extremely high temperatures existing during even the first moments of a chimney fire cause melting of the fusible element and therefore closing of the air flow restriction plate to restrict air flow through the chimney and thereby quickly extinguish combustion.

34 Claims, 7 Drawing Figures

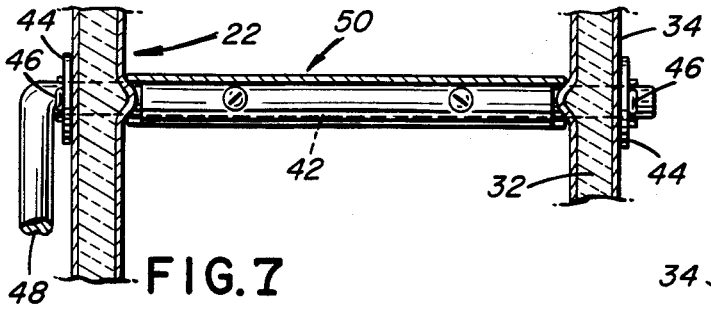
FIG. 7
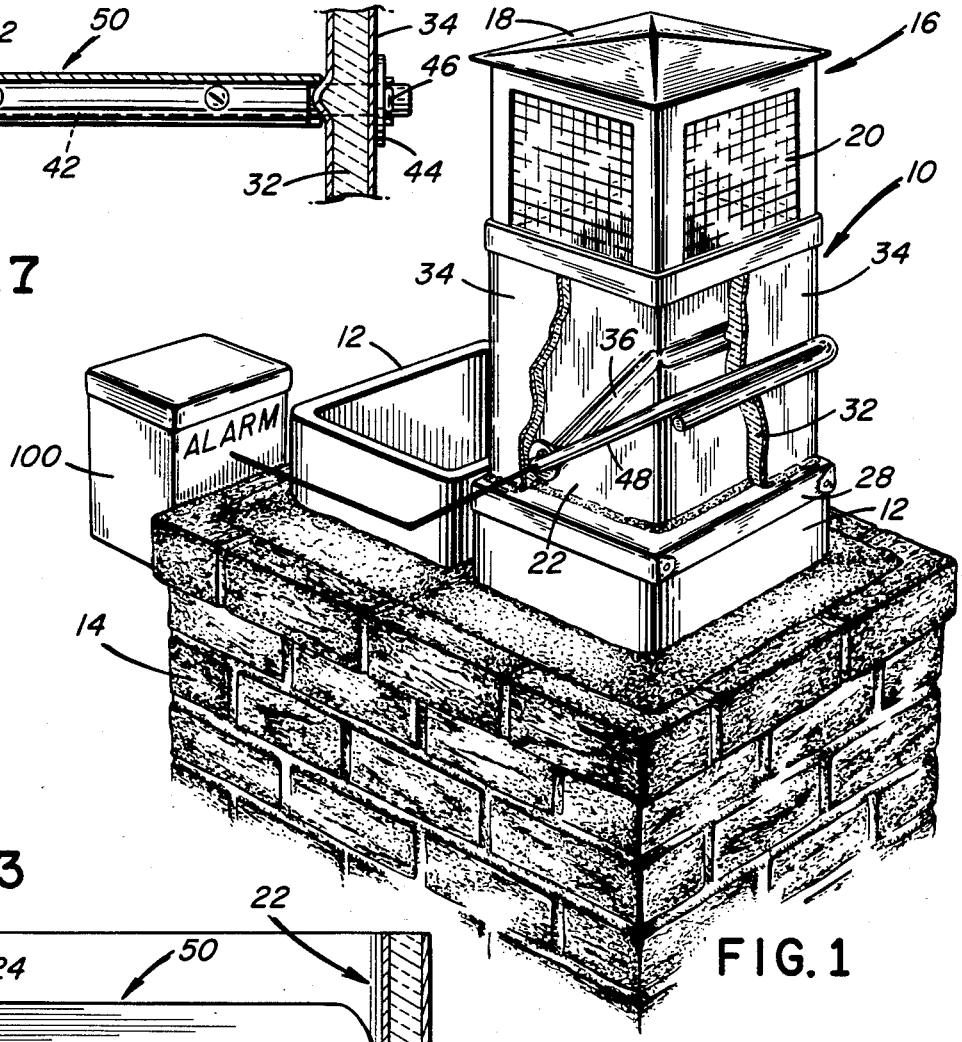
FIG. 1
FIG. 3
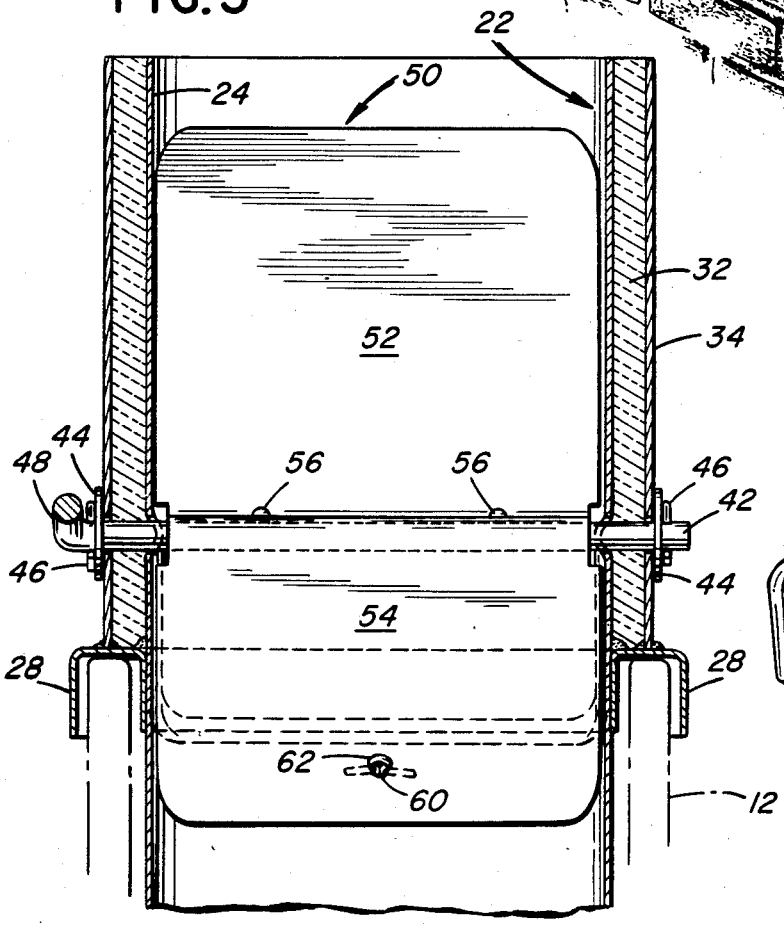
FIG. 6
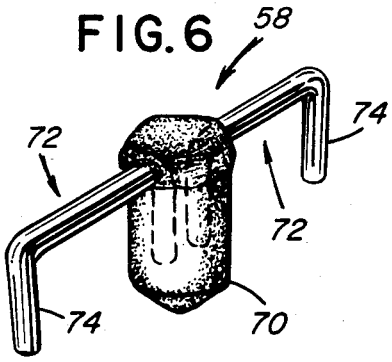

FIG. 2
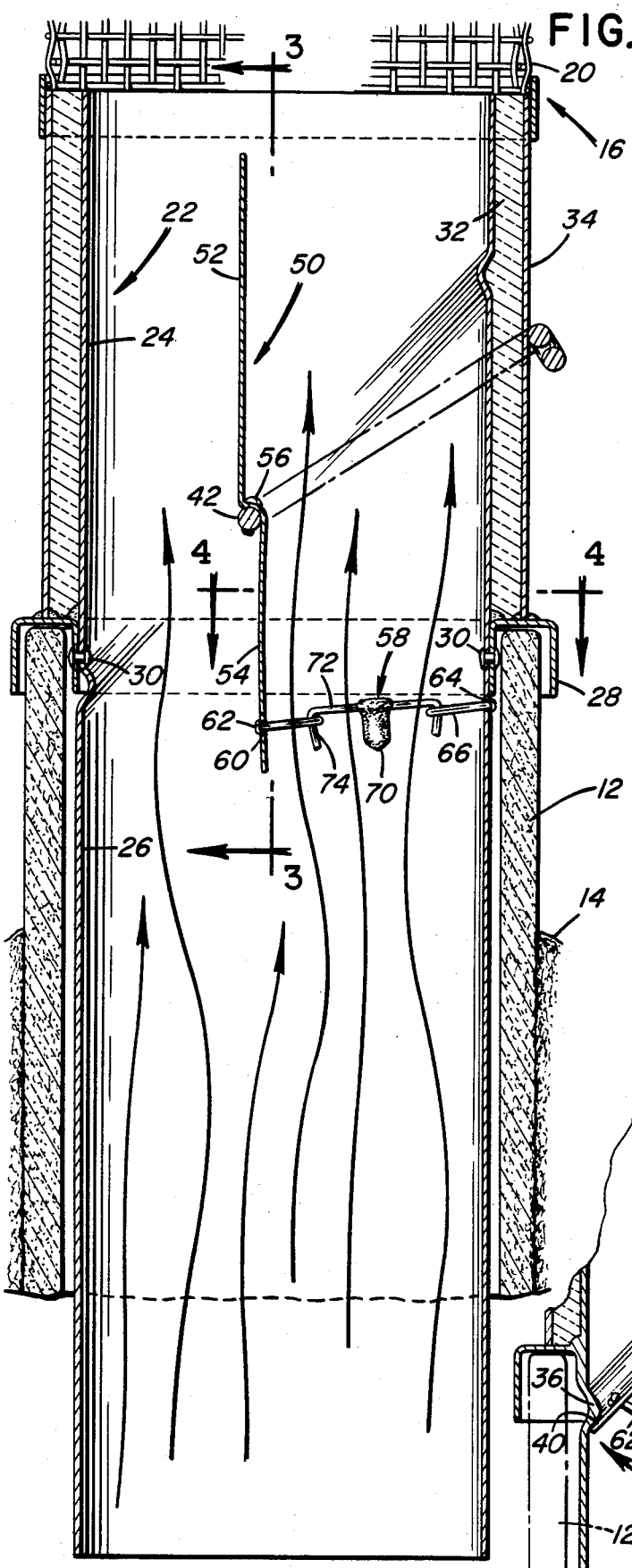
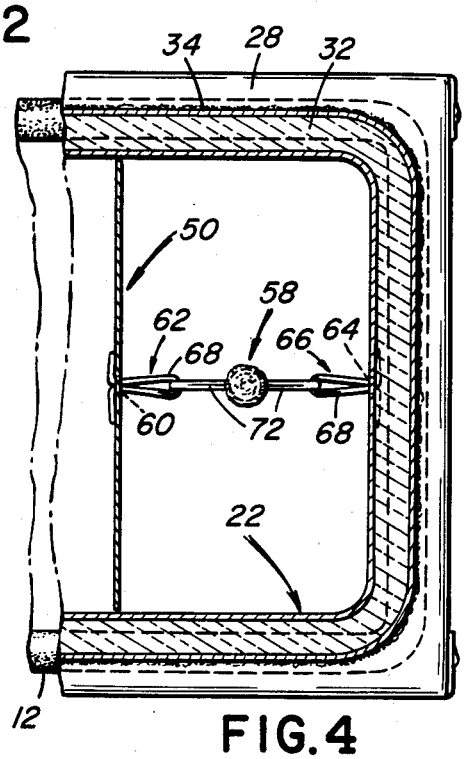
FIG. 4
FIG. 5
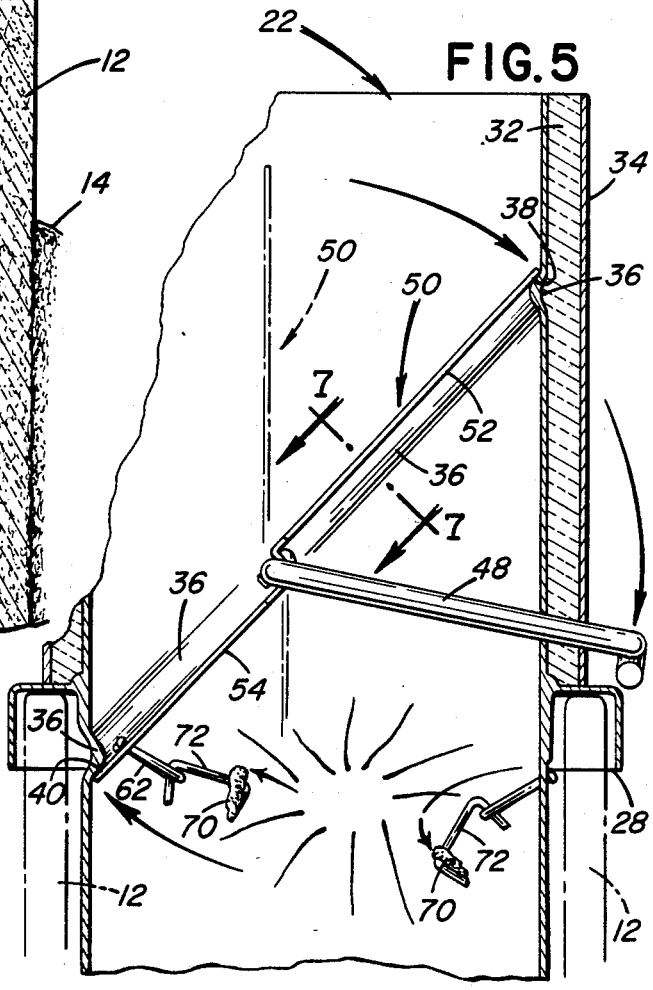

CHIMNEY FIRE EXTINGUISHING APPARATUS

BACKGROUND OF THE INVENTION

1. Field of the Invention

The invention relates generally to fire extinguishing apparatus useful in a chimney to extinguish chimney fires and particularly to a retrofittable cap for existing chimneys which can be placed over the upper exposed end of a chimney liner to be actuable under conditions of unusually high temperatures, such as occur during a chimney fire, to extinguish combustion within the chimney.

2. Description of the Prior Art

Substantial property losses occur each year due to fires which originate in the chimney of a fireplace, these fires typically resulting from the combustion of an accumulation of combustible materials on inner walls of a chimney. These accumulated combustible materials are the by-products of the burning of wood and other materials in the fireplace. Even thorough cleaning of a chimney does not guarantee protection against a chimney fire since these combustible materials accumulate rapidly and it is difficult to visually inspect a chimney to determine the presence of dangerous accumulations. Given the prevelance of chimney usage in rural areas and the resurgance of the use of wood heat in recent years, particularly in residences, it is perhaps not surprising that chimney fires account for a large percentage of fires in residences and likely account for over 15% of serious fires in rural areas. Due to the extreme heat and rapidity with which chimney fires burn, it is usually the case that the entire structure is lost. While the need has long existed to provide a solution to this substantial problem, no previous devices have been available which have been effective and have been capable of being retrofit to existing fireplace and chimney structures without the need for modification of the chimney structure itself. U.S. Pat. Nos. 314,121 to Gilman; 1,352,255 to Emerson and 2,270,073 to Merry are examples of prior sturctures which disclose the use of damper devices adapted to close in the event of a fire in a chimney structure to reduce oxygen flow to the fire. In these patents, a fusible element is employed which is fused by the heat of the fire to result in the closing of the damper. However, the structures shown in these patents and in other prior art require modification of the basic structure of the chimney and/or fireplace and must be installed in the chimney or fireplace at the time of construction. The need has thus been long felt for apparatus which can be retrofit to existing chimneys without modification of the basic structure of the chimney. Further, the need has further been felt for apparatus for extinguishing chimney fires which reduced the damage to the interior of a building caused by smoke which occurs even though the chimney fire itself may be extinguished. The present invention provides apparatus capable of extinguishing a chimney fire and which in a preferred embodiment allows a reduced air flow through the chimney which is insufficient to support combustion but which reduces the amount of smoke damage which can occur during a chimney fire even when the fire is extinguished. The present invention provides apparatus which can be simply placed on the upper exposed end of a chimney liner without modification of the chimney, the liner or the fireplace and which acts without additional assistance to extinguish fires within the chimney which occur as a result of the burning of accumulated combustible materials on the inner walls of a chimney structure.

SUMMARY OF THE INVENTION

The invention provides apparatus which can be fitted to the upper exposed end of a chimney liner in an existing chimney and which is actuable under conditions of unusually high temperatures, such as occur during a chimney fire, to substantially extinguish combustion within the chimney. As a particular advantage, the invention provides apparatus which can be fitted to existing chimney structures without alteration of the chimney or liner structure, the apparatus simply being placed over the upper exposed end of a chimney liner such as are presently required by code regulations for use with masonry and other chimney structures. The ability to locate the present apparatus on the upper end of a chimney not only allows ready installation of the apparatus to a chimney by unskilled personnel but also allows ready inspection of the apparatus to ensure operational capability. Even after a chimney fire has been extinguished by the present apparatus, the apparatus can be easily and rapidly refitted with a fusible element to place the apparatus in condition for extinguishment of yet another chimney fire.

The present apparatus includes an air flow restriction plate which is held in an open position, that is, a position allowing free flow through the chimney in a normal use situation including a situation wherein a fire burns in the fireplace associated with the chimney. A fusible element holds the air flow restriction plate in place in the open position during normal conditions, the fusible element not being affected by temperatures which normally exist during the burning of a fire in the fireplace itself. However, the extremely high temperatures existing even during the first moments of a chimney fire cause melting of the fusible element, thereby releasing the air flow restriction plate to allow the plate to assume a closed position which substantially restricts the flow of air through the chimney, thereby producing unfavorable combustion conditions which extinguish the fire. The air flow restriction plate is mounted for pivoting movement between open and closed positions within the present apparatus and is weighted to cause the plate to rapidly assume the closed position on melting of the fusible element. The air flow restriction plate is configured in a preferred embodiment to allow some air flow through the chimney as the chimney fire is extinguished, thereby to minimize smoke damage within a building which would be occasioned by a total cessation of air flow through the chimney. The configuration, size and weighting on the air flow restriction plate allows an intermittent flow or "burping" of air through the chimney in order to avoid a total backflow of smoke into the building in which the chimney is installed.

Accordingly, it is the primary object of the present invention to provide apparatus capable of fitting over the upper exposed end of a chimney liner and operable in the event of a chimney fire to extinguish the fire.

It is another object of the present invention to provide apparatus capable of extinguishing a chimney fire and which can be fit onto an existing chimney without modification of the chimney or fireplace structure.

It is yet another object of the present invention to provide an apparatus capable of extinguishing a chimney fire and which can be retrofit over the upper exposed end of a chimney liner without the need for modification of the chimney or fireplace and which can be fit thereon by unskilled personnel and easily inspected visually to determine operational capability.

Further objects and advantages of the present invention will become more readily apparent in light of the following detailed description of the preferred embodiments.

BRIEF DESCRIPTION OF THE DRAWINGS

FIG. 1 is a perspective view of the present apparatus fitted over the upper exposed end of a chimney liner located in a typical masonry fireplace, optional insulation fitted on the apparatus being shown partially removed for ease of illustration;

FIG. 2 is a side elevational view in section taken through portions of the present apparatus and portions of a chimney liner and chimney on which the present apparatus is installed;

FIG. 3 is a section taken along lines 3—3 of FIG. 2;

FIG. 4 is a section taken along lines 4—4 of FIG. 2;

FIG. 5 is a side elevational view in section and partially cut away which illustrates the actuation of an air flow restriction plate and fusible element according to the invention;

FIG. 6 is a perspective view of a fusible element configured according to the invention; and, FIG. 7 is a section taken along lines 7—7 of FIG. 5.

DESCRIPTION OF THE PREFERRED EMBODIMENTS

Referring now to the drawings and particularly to FIG. 1, a chimney fire extinguishing apparatus according to the present invention is seen generally at 10 to be mounted on the upper exposed end of a chimney liner 12 which forms a portion of a conventional masonry chimney 14. While the liner 12 in FIG. 1 is represented as a conventional ceramic/clay liner such as is required by code regulations for conventional masonry chimney structures, it is to be understood that the present apparatus 10 can be configured to mate with metal liners as well as other liners and chimney structures other than as explicitly shown in FIG. 1, the depiction of FIG. 1 simply being for purposes of illustration. The apparatus 10 can be seen to include a cap 16 which is substantially identical to caps which are presently employed to cover chimney structures from the elements as well as to prevent entry of foreign matter into the chimney. The cap 16 is provided with the usual upper cover 18 and has wire side walls 20 which allow gas and material flow through the chimney. Use of the wire side walls 20, with appropriate spacing between the wires forming said walls 20, can advantageously act to prevent the passage of cinders during a chimney fire. In many chimney fires, burning cinders emanating from the chimney land on the roof of the structure and initiate additional combustion which accounts for substantial damage. While the present apparatus 10 could be fitted to the upper end of the chimney which is not fitted with a liner such as the liner 12, it should be understood that the present apparatus 10 is structured to fit over a liner and is not intended for use without a liner. Building codes rightfully require the use of liners in chimney structures due in part to the fact that liners act to prevent air leakage through chimney walls which can cause a chimney fire or increase the likelihood of the occurrence of a chimney fire.

Referring now to FIGS. 1 through 4 in particular, the apparatus 10 is seen to be comprised of a tubular housing 22 which is substantially square in cross-section and which may have rounded corners as are best seen in FIG. 4. It should be understood that the tubular housing 22 can have cross-sections other than as shown and have 90° corners or the like depending upon design choice. The particular configuration shown is chosen primarily to mate with the usual contours of a chimney liner such as the liner 12 and to provide a cross-sectional area of the housing 22 which is as close as practical to the cross-sectional area of the liner 12. The tubular housing 22 is preferably formed of a metal such as aluminum, tin or the like or which is otherwise treated to resist the influence of the elements to which the apparatus 10 is exposed. The tubular housing 22 has an upper section 24 and a lower section 26, the lower section being substantially received within the liner 12 and extending thereinto to a distance which typically constitutes over half the length of the tubular housing 22. Although for purposes of illustration, the walls of the lower section 26 are seen to be spaced from the inner walls of the liner 12. In practice, this fitting is made as flush as is practical in order to provide an effective passageway for combustion gases and the like to move upwardly through the liner 12 and then through the tubular housing 22.

A collar 28 which is U-shaped in section is attached to the tubular housing 22 about the periphery thereof by means of rivets 30 or similar attachment means, the collar 28 acting to fit over upper edges of the liner 12 to mount the apparatus 10 in place on the liner 12. Those portions of the tubular housing 22 which are "below" the collar 28 constitute the lower section 26 while those portions of the tubular housing 22 which lie "above" the collar 28 constitute the upper section 24 of said tubular housing 22. The upper section 24 of the housing 22 is preferably covered with insulation 32 which can be held in place by a cover 34 formed of weather-resistant metal. The insulation 32, which is optional, acts to maintain somewhat higher temperatures within the upper section 24 of the apparatus 10 such that operation of the apparatus 10 is not inhibited by extremely cold temperatures. In most climate zones, temperatures do not reach sufficiently low levels as to cause a freezing up of moving parts operable within the apparatus 10 and thus the insulation 32 is not necessary to an effective functioning of the invention under usual circumstances. The cap 16, referred to primarily relative to FIG. 1, is seen in FIG. 2 to be mountable to the upper end of the tubular housing 22 and can be attached to the cover 34, or in the absence of the insulation 32 and thus the cover 34, directly to the uppermost end of the tubular housing 22, by means of screws or other fasteners (not shown).

As best seen in FIGS. 1 and 2, an indentation 36 is formed substantially within the surface of the upper section 24 of the housing 22, the indentation 36 extending diagonally across two opposite sides of the tubular housing 22 and horizontally across the two other opposite sides of said housing 22. In essence, the indentation 36 is continuous and substantially circumscribes a rectangular form though with corners which conform in shape to corners of the housing 22. Inner wall surfaces of the indentation 36 provide contact surfaces or lips 38 and 40, the lip 38 being the uppermost surface of the indentation 36 "above" the location of a pivot bar 42 and the lip 40 being a contact surface formed of the lowermost portions of the indentation 36 "below" the pivot bar 42. The pivot bar 42, as best seen in FIGS. 2 and 7, is mounted for pivotal movement between the two sides of the tubular housing 22 on which the indentation 36 is disposed diagonally. The pivot bar 42 can be seen to be mounted slightly "below" the center of the diagonal portion of the indentation 36 on each opposite side wall of said housing 22. As is best seen in FIG. 7, the pivot bar 42 is mounted at each end by conventional washers 44 and cotter key 46. The pivot bar 42, as best seen in FIGS. 1–3, 5 and 7, extends externally of the tubular housing 22 at a right angle for a length sufficient to extend to the farmost corner of the housing 22 whereupon the bar 42 again turns at a right angle and extends along essentially the full side wall of the tubular housing 22 before doubling back at an angle of 180° for a length substantially equal again to the side wall of the housing 22. This exterior portion 48 of the pivot bar 42 effectively comprises a balancing weight which acts to pivot the pivot bar 42 in a clockwise direction as seen FIG. 5 when no other constraints hold the pivot bar 42.

As is best seen in FIGS. 2 and 5, the pivot bar 42 has fastened to it an air flow restriction plate 50 which has an uppermost section 52 and a lowermost section 54, the sections 52 and 54 being parallel to each other but out of plane due to formation of the plate 50 in a tight S-curve at the juncture of said plate 50 and of the pivot bar 42. The plate 50 is joined to the pivot bar 42 by means of screws 56 or similar fasteners. The air flow restriction plate 50 is sized and shaped to form essentially a full blockage of the channel defined by the tubular housing 22 when the plate 50 is in the position shown in FIG. 5. When in the position shown in FIG. 5, edge portions of the uppermost section 52 of the plate 50 bias downwardly against the lip 38 of the indentation 36 while the peripheral edges of the lowermost section 54 of the plate 50 bias upwardly against the lip 40 of the indentation 36. The plate 50 is held in the position shown in FIG. 5 by virtue of the weight provided by the external portion 48 of the pivot bar 42 as described above. It is to be understood that the weight represented by the exterior portion 48 can be otherwise provided. However, the exterior portion 48 is conveniently formed and is easily observed visually from externally of the apparatus 10 and the chimney 14 so that it can be readily determined that the apparatus 10 is in an operable position.

The uppermost section 52 of the air flow restriction plate 50 can be seen particularly in FIG. 3 to be greater in area than the lowermost section 54, a difference of approximately 10% being preferred. The function of this size difference between the sections 52 and 54 of the plate 50 will be described in detail hereinafter.

Referring now primarily to FIGS. 2 and 4, the apparatus 10 is seen in a "set" position wherein the air flow restriction plate 50 is disposed in a substantially vertical orientation and held in this orientation by means of fusible element, the element 58 being best seen in FIG. 6. An aperture 60 formed near the lower end of the section 54 of the plate 50 has a yoke 62 held therein, an aperture 64 being formed in an oppositely facing wall of the housing 22 and further having a yoke 66 held therein, loop portion 68 of the yokes 62 and 64 extending toward each other when the plate 50 is in the vertical position as shown. The fusible element 58 is formed of a plug 70 of fusible material such as is well known in the art, the plug 70 being solid not only at ordinary environmental temperatures but also at temperatures existing in upper sections of a chimney during the burning of usual fires in a fireplace serviced by the chimney. The plug 70 has U-shaped connector 72 extending oppositely therefrom, the connector 72 having outer legs 74 which fit into the loop portion 68 of the yoke 62 and 66, thereby to hold the air flow restriction plate 50 in a vertical orientation as shown particularly in FIGS. 2 and 4. In this "set" position, the normal flow of gaseous and other products of combustion are free to flow upwardly through the liner 12 and the tubular housing 22 such that the chimney 14 functions normally. In this "set" position, the exterior portion 48 of the pivot bar 42 is seen to be located in an upward position against outer walls of the apparatus 10 and can be so observed to be in this position from externally of the chimney 14. Thus, the existence of a "set" condition is readily observed without the need for the inconvenience of looking up into a chimney from the fireplace or looking down into the chimney from an unsafe position on top of a building.

Referring now to FIG. 5, a representation of the operation of the apparatus 10 is provided under conditions such as would occur during the first instants of a chimney fire, such a fire burning with sufficient intensity to cause a virtually immediate melting of the plug 70 so as to disconnect the connector 72 and thus allow the air flow restriction plate 50 to be pivoted by the pivot bar 42 to the position as shown in FIG. 5 whereby the uppermost section 52 of the plate 50 impinges against the lip 38 and the lowermost section 54 of the plate 50 impinges against the lip 40 of the indentation 36 as noted above. The weight of the exterior portion 48 of the pivot bar 42 acts to maintain the air flow restriction plate 50 in position such that air flow through the liner 12 and thus the chimney 14 is restricted to the point that insufficient oxygen is available for combustion. The fire in the chimney 14 which caused actuation of the apparatus is thus starved of oxygen and is extinguished.

As is best seen in FIG. 5, it will be noted that a portion of the expanding gas moving through the liner 12 and thus through the tubular housing 22 causes a "lifting" pressure against the uppermost section 52 while a portion of the expanding gases causes a "closing" pressure against the lowermost section 54. The weight provided by the exterior portion 48 as aforesaid also produces a force which acts to hold the plate 50 in a blocking position. However, the greater surface area of the uppermost section 52 relative to the area of the lowermost section 54 provides a degree of "lifting" pressure of approximately 10% relative to the "closing" pressure exerted on the section 54. The existence of this slightly greater "lifting" pressure allows the plate 50 to be intermittently displaced in an angular fashion about the pivot bar 42 such that pressure can be relieved in essentially a "burping" fashion to prevent a "backing up" of smoke and the like into the interior of the building in which the chimney is installed, thereby acting to reduce smoke damage while still extinguishing a fire within the chimney 14. The weight provided by the exterior portion 48 or the equivalent is not critical but is chosen to be sufficient to readily close the plate 50 but to allow intermittently large pressure buildups within the chimney 14 to be relieved for the purposes noted. The exterior portion 48 of the bar 42 can be seen to comprise approximately two 8-inch lengths of approximately ½-inch bar stock, this weight along with the remaining exterior portion of the bar 42 being sufficient to operate in the manner indicated.

The fusible element 58 can be formed conventionally of lead or other fusible metals such as is well known in the art. The fusible element 58 can be formed other than is shown and described herein, it being possible to form the element 58 from a single length of fusible material without the requirement for the connector 72, as an example. Elemental lead and common lead alloys are seen to have appropriate melting points so as to be operable to melt under conditions which occur during a chimney fire.

It is to be understood that the present apparatus 10 can be configured other than as explicitly described herein yet remain within the intended scope of the invention. For example, the present apparatus is described as being used on a chimney which serves a fireplace. However, the apparatus can be used in association with a chimney structure operable with a woodburning stove or any woodburning apparatus useful within the confines of a building and which is vented to ambient by means of a chimney or flue. Further, the present apparatus 10 can be readily caused to operate an audible alarm or other alarm such as is represented schematically at 100 in FIG. 1. The alarm 100 is intended to provide a clear warning of the existence of a condition requiring attention and can be caused to operate an actuation of the apparatus 10. While the structure herein described is preferred, variations can occur and it is apparent to those skilled in the art that, given the above teachings, variations are possible and that the scope of the invention is defined appropriately according to the recitation of the appended claims.

What is claimed is:

1. Apparatus positionable on an upper portion of a chimney liner for extinguishing a chimney fire, comprising:

housing means carried by the liner for providing a vertical flow channel for combustion products passing through the liner, the flow channel being defined by interior walls of the housing means;

an air flow restriction plate mounted for pivotal movement between first and second positions, the first position of the plate allowing flow through the housing means and the second position restricting flow through the housing means;

means carried by the housing means for pivotally mounting the air flow restriction plate within the housing means along a pivot axis, the air flow restriction plate having a first section lying on one side of the pivot axis and a second section lying on the other side of the pivot axis, the first section surmounting the pivot axis and having a surface area greater than the second section;

means connected to the air flow restriction plate for maintaining the plate in the first position in the absence of temperatures associated with a chimney fire within the chimney liner; and, means carried by the housing means and associated with the air flow restriction plate for maintaining the plate substantially in the second position in the presence of temperatures associated with a chimney fire within the chimney liner, the plate being movable by gases exhausting through the flow channel and exerting greater pressure on the first section of the plate than on the second section to cause a net lifting force to effect at least some gas release through the housing means.

2. The apparatus of claim 1 and further comprising means connected to the apparatus for indicating the position assumed by the plate, thereby indicating whether the apparatus is in an actuable or other configuration.

3. The apparatus of claim 1 and further comprising cap means for covering the housing means to prevent extraneous material from entering the apparatus.

4. The apparatus of claim 3 wherein the cap means comprise apertured side walls to allow flow of gaseous products of combustion therethrough but retard the passage of cinders and embers out of the apparatus.

5. The apparatus of claim 1 and further comprising collar means joined to exterior walls of the housing means for mounting the apparatus to upper edge portions of the chimney liner.

6. The apparatus of claim 1 wherein the first and second sections of the air flow restriction plate are parallel to each other.

7. The apparatus of claim 6 wherein the first and second sections of the air flow restriction plate respectively lie in different planes.

8. The apparatus of claim 1 wherein the means for pivotally mounting the air flow restriction plate comprise a bar mounted for pivotal movement to opposite interior walls of the housing means.

9. The apparatus of claim 8 wherein the air flow restriction plate is of unitary construction, the first and said sections of the plate being parallel and respectively lying in different planes, the first and second sections being joined by a relatively short connecting portion which is fastened to the bar.

10. The apparatus of claim 8 wherein the means for mounting the plate substantially in the second position comprises a weight connected to the bar and extending externally of the chimney.

11. The apparatus of claim 1 wherein the surface area of the first section of the air flow restriction plate is 10% greater than the surface area of the second section.

12. The apparatus of claim 1 wherein the housing means has a portion insertible into the interior of the chimney liner and a portion extending externally of the liner.

13. The apparatus of claim 12 and further comprising insulation means formed over the portion of the housing means externally of the chimney for insulating the apparatus.

14. The apparatus of claim 1 and further comprising means carried by the interior walls of the housing means for at least partially sealing at least certain of the peripheral edges of the air flow restriction plate against flow of combustion products through the flow channel defined by the interior walls when the plate is in the second position.

15. The apparatus of claim 14 wherein the sealing means comprise indentations formed in at least certain of the interior walls of the housing means and extending into the flow channel, the indentations being integral with the walls and providing contact surfaces for peripheral edges of the plate when the plate is in the second position.

16. The apparatus of claim 15 wherein the indentations are continuous and extend about the full inner periphery of the flow channel.

17. The apparatus of claim 16 wherein the flow channel is essentially rectangular and the indentations extend diagonally across first opposite side walls and horizontally across second opposite side walls to circumscribe a substantially rectangular form.

18. The apparatus of claim 1 wherein the means for maintaining the plate in the first position comprise a fusible element which is meltable on occurrence of temperatures associated with a chimney fire, thereby to release the plate from the first position.

19. The apparatus of claim 18 and further comprising means for connecting a fusible element to the air flow restriction plate and means for connecting the fusible element to an interior wall of the housing means, melting of the fusible element on occurrence of temperatures associated with a chimney fire releasing the plate to allow the plate to assume the second position.

20. The apparatus of claim 1 and further comprising means associated with the air flow restriction plate for providing an indication of the existence of the plate in the second position.

21. The apparatus of claim 20 wherein the indication means comprise an audible alarm.

22. Apparatus positionable on an upper portion of a chimney liner for extinguishing a chimney fire, comprising:

housing means carried by the liner for providing a flow channel for combustion products passing through the liner, the flow channel being defined by interior walls of the housing means, the walls having indentations formed therein which extend into the flow channel, the indentations being integral with the walls;

an air flow restriction plate mounted for pivotal movement between first and second positions, the first position of the plate allowing flow through the housing means and a second position restricting flow through the housing means, the indentations providing contact surfaces for peripheral edges of the plate when the plate is in the second position;

means carried by the housing means for pivotally mounting the air flow restriction plate within the housing means along a pivot axis;

means connected to the air flow restriction plate for maintaining the plate in the first position in the absence of temperatures associated with a chimney fire within the chimney liner; and, means carried by the housing means and associated with the air flow restriction plate for maintaining the plate substantially in the second position in the presence of temperatures associated with a chimney fire within the chimney liner, said means for maintaining the plate substantially in the second position at least partially including the indentations formed in the interior walls of the housing means, the plate being movable by gases exhausting through the flow channel and exerting greater pressure on a first section of the plate than on a second section to cause a net lifting force to effect at least some gas release through the housing means.

23. The apparatus of claim 22 wherein the air flow restriction plate has said first section lying on one side of the pivot axis and said second section lying on the other side of the pivot axis, one of said sections having a surface area greater than the other of said sections.

24. The apparatus of claim 23 wherein the first section of the air flow restriction plate surmounts the pivot axis and has a surface area greater than the surface area of the second section.

25. The apparatus of claim 24 wherein the surface area of the first section of the air flow restriction plate is 10% greater than the surface area of the second section.

26. Apparatus positionable on an upper portion of a chimney liner for extinguishing a chimney fire, comprising:

housing means carried by the liner for providing a vertical flow channel for combustion products passing through the liner, the flow channel being defined by interior walls of the housing means, the walls having indentations formed therein which extend into the flow channel, the indentations being integral with the walls;

an air flow restriction plate mounted for pivotal movement between first and second positions, the first position of the plate allowing flow through the housing means and the second position restricting flow through the housing means, the indentations providing contact surfaces for peripheral edges of the plate when the plate is in the second position;

means for pivotally mounting the air flow restriction plate within the housing means along a pivot axis, said means comprising a bar mounted for pivotal movement to opposite interior walls of the housing means, the longitudinal axis of the bar lying along the pivot axis, the air flow restriction plate having a first section lying on one side of the bar and surmounting the bar, and a second section of the air flow restriction plate lying on the other side of the bar, the first section surmounting the pivot axis and having a surface area greater than the surface area of the second section, the first and second sections being parallel to each other and respectively lying in different planes, peripheral edges of the first section contacting upper surfaces of the indentations disposed uppermost on the interior walls of the housing means and peripheral edges of the second section contacting lower surfaces of the indentations disposed uppermost on the interior walls of the housing means;

means connected to the air flow restriction plate for maintaining the plate in the first position in the absence of temperatures associated with a chimney fire within the chimney liner; and, means carried by the housing means and associated with the air flow restriction plate for maintaining the plate substantially in the second position in the presence of temperatures associated with a chimney fire within the chimney liner, said means for maintaining the plate substantially in the second position at least partially including the indentations formed in the interior walls of the housing means, the plate being movable by gases exhausting through the flow channel and exerting greater pressure on the first section of the plate than on the second section to cause a net lifting force to effect at least some gas release through the housing means.

27. The apparatus of claim 26 wherein the air flow restriction plate is of unitary construction, the first and second sections being joined by a relatively short connecting portion which is fastened to the bar.

28. The apparatus of claim 26 wherein the surface area of the first section of the air flow restriction plate is 10% greater than the surface area of the second section.

29. The apparatus of claim 26 wherein the housing means has a portion insertible into the interior of the chimney liner and a portion extending externally of the liner, the apparatus further comprising insulation means formed over the portion of the housing means externally of the chimney for insulating the apparatus.

30. The apparatus of claim 26 wherein the indentations are continuous and extend about the full inner periphery of the flow channel.

31. The apparatus of claim 30 wherein the flow channel is essentially rectangular and the indentations extend diagonally across first opposite side walls and horizontally across second opposite side walls to circumscribe a substantially rectangular form.

32. The apparatus of claim 26 wherein the means for maintaining the plate substantially in a second position at least partially comprises a weight connected to the bar and extending externally of the chimney.

33. The apparatus of claim 26 wherein the means for maintaining the plate in the first position comprises a fusible element which is meltable on occurrence of temperatures associated with a chimney fire, thereby to release the plate from the first position.

34. The apparatus of claim 33 and further comprising means for connecting the fusible element to the air flow restriction plate and means for connecting the fusible element to an interior wall of the housing means, melting of the fusible element on occurrence of temperatures associated with a chimney fire releasing the plate to allow the plate to assume the second position.

* * * * *